United States Patent [19]

Herbstler et al.

[11] Patent Number: 4,824,415

[45] Date of Patent: Apr. 25, 1989

[54] DOLL WITH REMOTE CONTROLLED SUPPORTING ACCESSORY

[75] Inventors: Horst-Dieter Herbstler, Bolingbrook; Rouben T. Terzian, Chicago, both of Ill.

[73] Assignee: Marvin Glass & Associates, Chicago, Ill.

[21] Appl. No.: 154,653

[22] Filed: Feb. 10, 1988

[51] Int. Cl.[4] ..... A63H 15/04; A63H 17/25; A63H 11/18; A63H 17/25

[52] U.S. Cl. ..... 446/276; 446/277; 446/355; 446/288

[58] Field of Search ..... 446/276, 277, 158, 351, 446/355, 288

[56] References Cited

U.S. PATENT DOCUMENTS

| | | | |
|---|---|---|---|
| 610,926 | 10/1948 | Borchard | 446/276 |
| 1,684,287 | 9/1928 | Paluck | 446/276 |
| 3,077,052 | 2/1963 | Gardel et al. | 446/277 |
| 3,359,680 | 12/1967 | Lindsay | 446/288 |
| 3,940,879 | 3/1976 | Glass et al. | 446/276 |
| 4,286,406 | 9/1981 | Sims et al. | 446/246 |
| 4,386,479 | 6/1983 | Terzian et al. | 446/276 |
| 4,411,100 | 10/1983 | Suimon | 446/460 |
| 4,457,101 | 7/1984 | Matsushiro | 446/456 |
| 4,591,158 | 5/1986 | Samson et al. | 446/288 |

FOREIGN PATENT DOCUMENTS

| | | | |
|---|---|---|---|
| 2150450 | 7/1985 | United Kingdom | 446/276 |

*Primary Examiner*—Robert A. Hafer
*Assistant Examiner*—Michael Brown
*Attorney, Agent, or Firm*—John S. Pacocha

[57] ABSTRACT

A doll with articulated legs and an articulated neck is releasably connected to a motor driven, steerable, remote controlled shopping cart. Movement of the cart causes a cam driven set of handles, to which the doll is attached, to pivot from side-to-side causing the doll to rock from side-to-side alternately lifting one leg and then the other. The accessory has two motors driving separate wheel axles that are each connected through a spring clutch to independently drive the cam. Remote control of the separate motors effects turning of the accessory. As each side of the doll is lifted from the ground, the respective leg is lifted and an eccentric weight within the lifted leg causes the leg to step forwardly.

9 Claims, 2 Drawing Sheets

TRANSMITTER
111
RECEIVER
110
SW A
SW B
SW C
SW D

DOLL WITH REMOTE CONTROLLED SUPPORTING ACCESSORY

BACKGROUND OF THE INVENTION

1. Field of the Invention

This invention relates generally to dolls and more particularly to walking dolls.

2. Background Art

Combinations of dolls with moveable limbs and supporting accessories are old in the art. Terzian et al. U.S. Pat. No. 4,386,479 issued June 7, 1983 discloses a walking doll releasably connected to a stroller through a handle that oscillates from side-to-side as the stroller is pushed forwardly by the child to create the impression that the doll is walking along with the stroller. Schneider U.S. Pat. No. 3,453,772 issued July 8, 1969 shows a doll with pivotal legs detachably mounted in a wheeled walker adapted to be pulled along by the child. Noyes U.S. Pat. No. 2,827,733 issued Mar. 25, 1958 also shows a doll with back and forth pivoting legs that is connected alongside a wheeled doll carriage which the child pushes. The dolls of these three patents have the advantage that they are relatively lightweight and, hence, upon being disconnected from the wheeled accessory may be readily used in other conventional doll play. Terzian et al. U. S. Pat. No. 4,467,555 issued Aug. 28, 1984 and Douglas et al. U.S. Pat. No. 3,475,857 issued Nov. 14, 1969, disclose dolls with motor driven pivoting legs that can be connected to a wheeled accessory such that the feet of the doll contact a supporting surface to propel both the doll and the wheeled accessory along the surface. Tomaro U.S. Pat. No. 3,590,520 issued July 6, 1971 discloses a doll with motor driven reciprocating arms that is connected to a seat supported by springs from a frame for enhanced rocking. Douglas et al. U.S. Pat. No. 3,514,897 issued June 2, 1970 shows a doll with motor driven pivoting legs connected to the peddles of a tricycle. Levine U.S. Pat. No. 3,653,152 issued Apr. 4, 1972 shows a doll seated in a toy vehicle with a pull string motor that both drives the vehicle and animates the head of the doll. However, there remains a need for a doll with moveable legs combined with an accessory that the child can control the movement of without having to actually push or pull the accessory.

SUMMARY OF THE INVENTION

The present invention is concerned with providing a doll and a remote controlled, self-propelled accessory combination in which the accessory houses a motor and remote control components. A doll having an articulated feature is removably attachable to the accessory such that movement of the accessory imparts motion to the feature. Thus, a doll with legs mounted for pivotal movement to simulate walking and a side-to-side turning head is attached to a remote controlled accessory such as a shopping cart. Separately controlled motors each propel one side of the accessory and each motor independently drives a cam effecting the articulation.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figures 1, 2, 7:
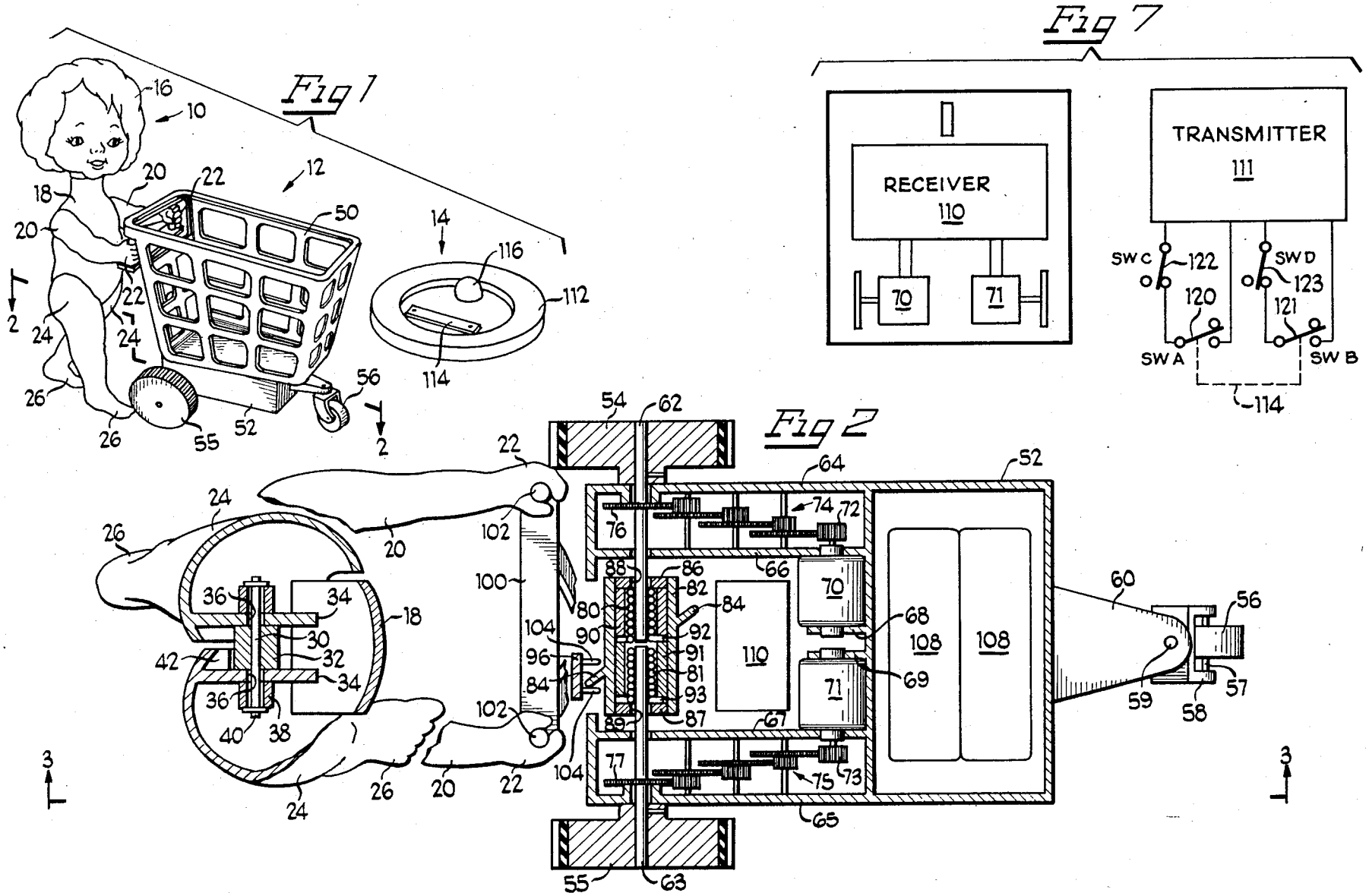
FIG. 1 is a perspective view of an embodiment of the present invention.
FIG. 2 is an enlarged scale, sectional view taken generally along line 2—2 of FIG. 1.
FIG. 7 is a schematic view of the remote control.

Referring now to the drawings in which like parts are designated by like reference numerals throughout the several views, FIG. 1 shows a doll 10 releasably connected to a motor driven supporting accessory 12 and a remote control 14 for the accessory. Doll 10 has a head 16, a torso 18, arms 20 with grasping hands 22 and legs 24 with feet 26.

Figures 3, 4, 5, 6:
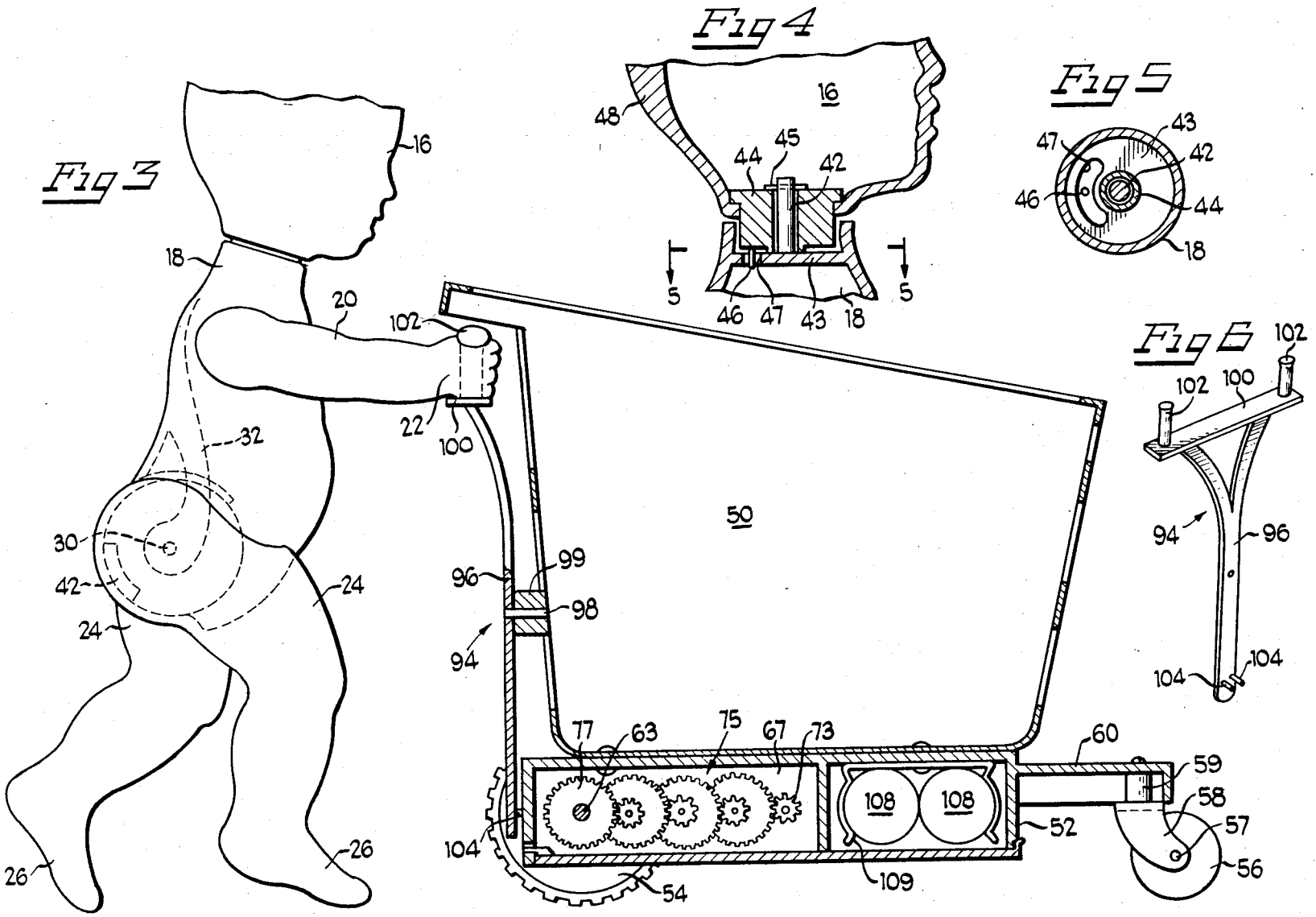
FIG. 3 is a sectional view taken generally along line 3—3 of FIG. 2.
FIG. 4 is an enlarged scale, generally vertical sectional view through the center of the head, neck and torso of the doll.
FIG. 5 is a sectional view taken generally along line 5—5 of FIG. 4.
FIG. 6 is a perspective view of the doll connecting drive handle.

As is best shown in FIGS. 2 and 3, each leg 24 is connected to torso 18 for pivotal movement, adjacent the upper end of the leg, about the axis of a shaft 30. A strut 32 that is integrally formed as part of torso 18 and extends downwardly and inwardly from the back of the torso carries shaft 30. Each leg 24 has an inwardly facing disk 34 forming the upper, inwardly facing thigh portion of the leg. Through each disk is a bore 36 that is of a larger diameter than the diameter of shaft 30 so that each leg rotates or pivots freely about the axis of shaft 30. Fitting over the protruding ends of shaft 30 are spacer bushing 38 and press fitted cap nuts 40. Adjacent the outer rearward periphery of each disk 34 is an eccentric weight 42. Because of the eccentric weight, each leg is biased to pivot the foot upwardly and forwardly by weight 42 rotating to a position directly below the axis of shaft 30 whenever a foot of a leg is lifted off a supporting surface.

Head 16 is mounted for pivotal side-to-side movement with respect to torso 18 about a shaft 42 that is secured to a shelf 43 that is integrally formed as part of torso 18. The axis of shaft 42 extends generally along the top to bottom length of the torso. A neck bushing 44 fits over and freely pivots about shaft 42. Bushing 44 is retained against removal by a pin 45 extending transversely through shaft 42. In order to fit head 16, which is made of a resilient material such as vinyl, onto bushing 44, the head, or more particularly, the bottom neck opening is deformed. After the head is fitted onto the bushing, the head returns to its normal shape and size so that it is retained on the pivots with the bushing. Depending from bushing 44 is a pin 46 that is received in an arcuate slot 47 in shelf 43. There is an enlarged mass 48 formed in the back post of head 16 so that the head will pivot from one side to the other when torso 18 is rocked from one side to the other. Pin 46 riding in slot 47 limits the side-to-side pivotal movement of the head.

Accessory 12 is in the form of a shopping cart having a basket 50 atop an undercarriage 52. Mounted on the undercarriage for rolling movement of accessory 12 along a substantially planar surface are spaced apart rear wheels 54 and 55. In addition, there is a front caster wheel 56 that rotates about an axle 57 carried by a fork 58 that pivots about a post 59. The axis of post 59, which is carried by a forward extension 60 of undercarriage 52, is substantially transverse to the axis of axle 57.

Wheels 54 and 55 are each secured on a respective axle 62 and 63 for rotation with the axle. Each of the axles is journaled for rotation between a respective one of outer walls 64, 65 of undercarriage 52 and one of spaced apart inner walls 66, 67. Spaced further inwardly from each of internal walls 66, 67 are respective uprights 68, 69. Between each set of adjacent internal walls 66, 67 and uprights 68, 69 a respective motor 70, 71 is mounted. Motor 70 has an output pinion 72 and motor 71 has an output pinion 73. Journaled between each set of an outer wall 64, 65 and a spaced apart inner wall 66, 67 is a respective speed reducing gear train 74, 75. On each axle 62, 63 is a respective axle gear 76, 77 that is secured to the axle for rotation with the axle. Engagement of respective pinions 72, 73, and gear trains 74, 75 with one of axle gears 76, 77 drives axles 62, 63 and their respective wheels 54, 55.

The free end of each axle 62, 63, opposite the attached wheel is fitted into a respective coil spring 80, 81 that serves as a clutch. Both axles are of the same diameter and the inner diameter of each coil spring substantially conforms to the outer diameter of the axles. Accordingly, with the spring anchored, when an axle is rotated in one direction it slips with respect to the spring and when the axle is rotated in the opposite direction it engages the spring and transmits rotartion through the spring. Springs 80 and 81 are both in driving engagement with a cam sleeve 82 having an outwardly extending spiral fin 84 that functions as a cam. At one end of sleeve 82 there is a press fitted cap 86 and at the other end there is a press fitted cap 87. Each cap 86, 87 has a central bore 88, 89 that rotatably receives and provides a bearing surface for axles 62 and 63, respectively.

Within cam sleeve 82 there are inner sleeves 90 and 91 that are press fitted or keyed with respect to cam sleeve 82 so as to be in rotational driving engagement with cam sleeve 82. An end 92 of spring 80 is anchored to inner sleeve 90 adjacent inner sleeve 91 while an end 93 of spring 81 is anchored to inner sleeve 91 adjacent cap 87. Accordingly, when wheel 54 and axle 62 are rotated to drive accessory 12 forwardly, the axle will tighten spring 80 and drive cam sleeve 82. Similarly, when wheel 55 and axle 63 are rotated to drive accessory 12 forwardly, axle 63 will tighten spring 81 and rotate cam sleeve 82. However, when either axle is stopped, or when the axle is driven in the reverse direction to that of forwardly moving the accessory, the respective spring will slip on the respective axle and cam sleeve 82 will continue to be driven by the one wheel that is rotating to move the accessory forwardly.

Attached to the back of the shopping car basket 50 is a pivoting doll connecting handle assembly 94 including a Y-shaped handle 96. The handle is connected for pivotal movement adjacent the back of shopping cart basket 50 for side-to-side pivotal movement about the axis of a shaft 98 that is anchored in a boss 99 mounted on the back end of the basket. A bar 100 with spaced apart pegs 102 is secured adjacent the split apart upper end of Y-shaped handle 96. One of each of grasping hands 22 fits about a peg 102 to releasably connect doll 10 to accessory 12 with the doll in an upright standing position and having feet 26 on the same supporting surface as the accessory. Adjacent the bottom end of handle 96 there are a pair of spaced apart pins 104 that extend in toward the back of accessory 12 and ride on either side of spiral fin 84. Accordingly, as cam sleeve 82 rotates, spiral fin 84 will engage one or the other of pins 104 and pivot the lower end of handle 96 back and forth about the axis of the shaft 98. Of course, such pivotal movement of the lower end of the handle will also pivot the upper end of the handle including pegs 102 about which hands 22 of the doll are attached.

Side-to-side pivotal movement of the upper end of handle 96 will be transmitted to torso 18 of the doll through hands 22 and arms 20. As a result, doll 10 will rock from side-to-side lifting the weight off of one leg and shifting it all onto the other leg. As the one leg is lifted off the supporting surface it will automatically pivot forwardly because of eccentric weight 42. The continued forward motion of a accessory 12 will cause first one leg and then the other to be lifted and pivoted forwardly to create the impression that the doll is walking along behind the accessory and pushing it.

A set of batteries 108 are mounted in a clip 109 on undercarriage 52. The batteries provide power to motors 70 and 71 as well as to a conventional remote control radio receiver 110 of remote control 14. Another set of batteries (not shown) is contained in a housing 112 for a conventional remote control radio transmitter 111 compatible with receiver 110. Atop remote control transmitter housing 112 is a switch bar 114 and a rotating turning control knob 116.

Upon pushing switch bar 114 down, normally open switches 120 and 121 are closed and a signal will be transmitted to drive both motors 70 and 71 in the direction to drive accessory 12 forwardly. In addition to switch 120, motor 70 is controlled by a normally closed switch 122 and motor 71 is controlled by a normally closed switch 123 in addition to switch 121. When turning knob 116 is centered for straight, forward drive of accessory 12, both switches 122 and 123 remain closed. However, when the knob 116 is turned to one side, one of normally closed switches 122, 123 is opened while the other remains closed. Thus, when knob 116 is rotated to the right, normally closed right side switch 123 is opened so that the power to motor 71 is cut off and the rotation of wheel 55 is stopped. As long as knob 116 is turned to the right, switch 122 will remain closed and motor 70 will continued to rotate and drive wheel 54 moving the left side of the accessory forwardly and causing the accessory to turn to the right. By turning rotary knob 116 to the left, switch 122 is opened while switch 123 remains closed and the accessory turns to the left. Regardless of which axle and wheel are turning, cam sleeve 82 will continue to rotate and pivot handle 96 from side-to-side causing doll 10 to rock from side-to-side lifting first one leg and then the other in a simulated walking motion behind the shopping cart.

While a particular embodiment of the present invention has been shown and described, changes and modifications will occur to those skilled in the art. For example, instead of a shopping cart, the remote control accessory could be a carriage, stroller, walker or even a rocking horse. Although, it is desirable to maintain the weight of the doll at a minimum to facilitate other conventional doll play, some components of the remote controlled motor system and/or batteries could be housing in the doll. It is intended in the appended claims to cover all such changes and modifications as fall within the true spirit and scope of the present invention.

What is claimed as new and desired to be secured by Letters Patent is:

1. A doll and supporting accessory comprising in combination:

a doll having a torso, head, arms and legs;

the head being mounting atop the torso;

the arms being mounted at each side of the torso, adjacent the top of the torso;

each leg being pivotally connected adjacent a bottom side of the torso for pivotal movement about an axis extending laterally through the torso and substantially transverse to the axis about which the head pivots;

means causing each leg to swing forwardly when the leg is lifted off of a supporting surface upon which the doll is standing;

a motor driven, steerable wheeled vehicle accessory;

means for remotely controlling forward and side-to-side movement of the motor driven accessory;

means on the accessory cooperating with the doll for removably connecting the doll to the accessory in a generally upright standing position with the legs on the supporting surface;

a rotating cam on the accessory and a cam follower on the means for removably connecting the doll cooperating with the cam for generating pivotal motion of the means for removably connecting the doll in response to the remotely controlled driven movement of the accessory so as to rock the doll from side-to-side to cause one leg after the other to be lifted from the supporting surface;

a pair of spaced apart, substantially coaxial wheels on the wheeled vehicle;

means for independently driving each one of the pair of wheels in one direction to move the accessory forward or to one or the other side;

each of the wheels being mounted on an end of a separate coaxial axle;

each of the axles having an inner end opposite the wheel; and means maintaining the inner end of each axle in drivable engagement with the cam only upon rotation of the axle in the one direction.

2. The doll and accessory of claim 1 in which:

the motor driven accessory has a pair of motors; and each of the motors power one of the wheels.

3. The doll and accessory of claim 1 in which the means maintaining the inner end of each axle in drivable engagement with the cam only upon rotation of the axle in the one direction is a spring clutch associated with each axle.

4. The doll and accessory of claim 3 in which:

the motor driven accessory has a pair of motors; and each of the motors power one of the wheels.

5. The doll and accessory of claim 3 including:

means mounting the head for side-to-side pivotal movement generally about an axis extending through the torso from top to bottom; and means causing the head to pivot from side-to-side as the doll is rocked from side-to-side.

6. The doll and accessory of claim 3 in which:

each one of the pair of axles has substantially the same outer diameter;

each spring clutch is a coil spring having an inner diameter that substantially conforms to the outer diameter of an axle; and one end of the coil spring is in anchored engagement with the cam so that when the axle is rotated in the one direction, the axle engages the spring and transmits rotation through the anchored end of the spring to the cam.

7. The doll and accessory of claim 6 in which:

the motor driven accessory has a pair of motors; and each of the motors power one of the wheels.

8. The doll and accessory of claim 6 including:

means mounting the head for side-to-side pivotal movement generally about an axis extending through the torso from top to bottom; and means causing the head to pivot from side-to-side as the doll is rocked from side-to-side.

9. The doll and accessory of claim 1 including:

means mounting the head for side-to-side pivotal movement generally about an axis extending through the torso from top to bottom; and means causing the head to pivot from side-to-side as the doll is rocked from side-to-side.

* * * * *